US005435656A

United States Patent [19]

Gugel et al.

[11] Patent Number: 5,435,656

[45] Date of Patent: Jul. 25, 1995

[54] BACK STOP STRUCTURE FOR MATRIX PIN PRINT HEAD

[75] Inventors: Bernd Gugel, Ulm-Einsingen; Johann Stempfle, Pfaffenhofen, both of Germany

[73] Assignee: Mannesmann Aktiengesellschaft, Düsseldorf, Germany

[21] Appl. No.: 184,066

[22] Filed: Jan. 21, 1994

Related U.S. Application Data

[63] Continuation of Ser. No. 3,310, Jan. 12, 1993, abandoned, which is a continuation of Ser. No. 583,479, Sep. 17, 1990, abandoned.

[30] Foreign Application Priority Data

Sep. 18, 1989 [EP] European Pat. Off. ..... 89250038

[51] Int. Cl.[6] ..... B41J 2/275

[52] U.S. Cl. ..... 400/124.05; 400/124.06; 400/124.17; 400/124.22

[58] Field of Search ..... 400/157.3, 166, 124.05, 400/124.06, 124.17, 124.22; 101/93.02, 93.03, 93.05

[56] References Cited

U.S. PATENT DOCUMENTS

| | | | |
|---|---|---|---|
| 3,929,214 | 12/1975 | Hebert | 101/93.05 |
| 4,141,661 | 2/1979 | Geis et al. | 400/124 |
| 4,260,270 | 4/1981 | Cavallari | 400/124 |
| 4,367,962 | 1/1983 | Gaboardi | 400/124 |
| 4,443,122 | 4/1984 | Blomquist et al. | 400/124 |
| 4,476,781 | 10/1984 | Kubacki et al. | 400/157.3 |
| 4,594,010 | 6/1986 | Jachno | 400/124 |
| 4,600,321 | 7/1986 | Kwan | 400/124 |
| 4,643,598 | 2/1987 | Pruski | 400/124 |
| 4,793,252 | 12/1988 | Pichler | 400/124 |
| 4,822,187 | 4/1989 | Gugel | 400/124 |
| 5,039,238 | 8/1991 | Kikuchi et al. | 400/124 |
| 5,054,942 | 10/1991 | Bernardis et al. | 400/124 |

FOREIGN PATENT DOCUMENTS

| | | | |
|---|---|---|---|
| 2778 | 1/1982 | Japan | 400/124 |
| 104952 | 6/1984 | Japan | 400/124 |
| 120468 | 7/1984 | Japan | 400/124 |
| 31771 | 2/1988 | Japan | 400/157.3 |

OTHER PUBLICATIONS

IBM Technical Disclosure Bulletin, vol. 31, No. 4, Sep. 1988 "Controls for Automated Adjustment of Print Wire Seal Time", pp. 347–351.

Xerox Disclosure Journal, vol. 1 No. 7, Jul. 1976, "Automatic Impression Control", p. 31.

*Primary Examiner*—Edgar S. Burr
*Assistant Examiner*—Stephen R. Funk
*Attorney, Agent, or Firm*—Horst M. Kasper

[57] ABSTRACT

A matrix pin print head is set to a fixed distance (17) relative to a print counter support (2), where a recording substrate (3) rests on the print counter support (2). An ink ribbon (4) is guided in front of the print pins (5) between the matrix pin print head (1) and the recording substrate (3). Electromagnetic-coil pin drives (8, 9, 10) are coordinated jointly to the print pins (5) or individually to each print pin (5). Each print pin (5) can be moved within a stroke path (16) from a rearward withdrawn position (18) into a forward extended position (19) and back. In order to adjust the operating air gap (25) between a magnet yoke (9) and a clapper armature (10) during its operation, it is provided that the drive energy, fed of equal size in each case to each print pin (5), is changeable in each case in uniform amounts, i.e. by equal amounts, to enlarge or to decrease the drive energy fed to the respective print pin (5).

23 Claims, 6 Drawing Sheets

BACK STOP STRUCTURE FOR MATRIX PIN PRINT HEAD

This is a continuation of application Ser. No. 08/003,310, filed Jan. 12, 1993, now abandoned which in turn is a continuation of application, Ser. No. 07/583,479, filed Sep. 17, 1990 now abandoned.

BACKGROUND OF THE INVENTION

1. Field of the Invention

The invention relates to a matrix pin print head, which is adjustable or is adjusted at a fixed distance relative to a print support, where a recording substrate rests on the print support, and where an ink ribbon is disposed and guided in front of the print pins and between the matrix pin print head and the recording substrate, where drives are provided together with the print pins or individually coordinated to each print pin, where an electromagnetic coil is associated in each case with the drives, and wherein each print pin is movable within one stroke from a rearward withdrawn position into a forward extended position and back.

2. Brief Description of the Background of the Invention Including Prior Art

In a special category of matrix pin print heads the drive comprises in each case a clapper armature driving the print pin. In a rearward rest position, all clapper armatures rest with a radially inner clapper armature end at a joint face and all radially outer clapper armature ends transfer the drive force. Furthermore, the path of each print pin up to a forward extended print position corresponds to the clapper-armature stroke path.

The invention is further concerned with a method for controlling the print pins of a matrix pin print head for the purpose of adaptation to the number of copies to be printed and/or for the purpose of adapting the print frequency in the sense of a change of the print speed of a matrix printer.

Such matrix pin print heads in matrix pin printers are known from the U.S. Pat. No. 4,230,038 for the setting of all armatures to one single operating air gap and from the German Patent Application Laid Open DE-OS 3,412,855 for a permanently fixed setting of the operating air gap between magnet yoke and clapper armature.

Modern matrix pin print heads are operated today with pin frequencies of from 1000 to 3000 Hz. The print pin and the drive element of the print pin are therefore furnished with a lowest possible mass for physical purposes. On the other hand, a high number of readable copies are required from matrix pin printers which requires a high impact force of the individual print pins.

A high impact force of each individual print pin would be possible in case of a correspondingly large mass of the moving parts, i.e. the print pin and the corresponding drive element, or, alternatively, a high impact energy would be generated via a large pin stroke path in case of a large acceleration. The two requirements, the high pin frequency and the high number of copies of a printed substrate piece, represent technically opposite and contradictory requirements relative to a matrix pin print head. Therefore, it was necessary to make compromises in the construction which, however, have not been satisfactory so far.

The performance and capacity data of a matrix pin print head are determined, amongst others, by the following parameters:

dimension of the magnet circuit,
material qualities of the magnet yoke with armature,
characterizing values of the electromagnetic coil,
moments of mass inertia of moving mass, and
dimension of the operating air gap.

After fixing of the dimensions of a matrix pin print head, theoretically after its assembly and mounting, only the operating voltage and the current feed curve can be changed from the outside. Such an influence however does not result in the desired effect after a matrix pin print head has been constructed with permanently fixed dimensions.

SUMMARY OF THE INVENTION

1. Purposes of the Invention

It is an object of the present invention to provide an adjustable matrix pin print head which can be adjusted in an assembled state such that the impact force, occurring at the print pins, can be changed in order to allow to produce a larger or smaller number of copies of the printed substrate material.

It is another object of the present invention to construct a matrix pin print head which is capable of adjusting the print speed frequency.

It is yet a further object of the present invention to provide a matrix pin print head which can be used both for high-speed printing and as a matrix pin print head providing large pin impact forces for a simultaneous printing of numerous copies.

These and other objects and advantages of the present invention will become evident from the description which follows. 2. Brief Description of the Invention The present invention provides for a matrix pin print head with a print counter support for supporting a recording substrate. An ink ribbon is guided in front of print pins and between the print pins and the recording substrate. A plurality of pin drives corresponds to the plurality of print pins and each individual pin drive of the plurality of pin drives is coordinated to an individual print pin of the plurality of the print pins. A plurality of electromagnetic coils corresponds to the number of drives, with each individual electromagnetic coil associated with one corresponding pin drive of the plurality of pin drives. Each individual print pin is movable within a stroke path from a rearward withdrawn position into a forward extended position and back. A drive energy, fed of substantially equal size in each actuation case to each print pin, is adjustable proportionally and uniformly for the plurality of print pins such that the drive energy can be set and controlled to be reduced or enlarged proportionally and uniformly for all print pins.

Adjustment means for servo adjusting the drive energy can be furnished uniformly to the plurality of drive pins.

A plurality of clapper armatures can be furnished in a number equal to the number of print pins of the plurality of print pins. Each clapper armature of the plurality of clapper armatures can act upon a corresponding print pin of the plurality of print pins. The adjustment means can be a plurality of adjustable stops corresponding in number to the number of print pins. Each print pin can correspond to one stop of the plurality of stops. The stops can be furnished for a rest position for each of the clapper armatures. The position of the stop can be adjusted at a fixed distance relative to the print counter support.

A plurality of structural faces can be provided, where the number of faces corresponds to the number of clapper armatures. Each structural face can correspond to one clapper armature of the plurality of clapper armatures. All clapper armatures can rest in a rearward withdrawn position with a radially inner clapper armature end at the plurality of faces. Each of the clapper armatures can have a radially outer end to transfer a drive force. The path of each print pin up into a forward extended print position can correspond to a clapper armature stroke path.

The plurality of structural faces can be disposed at a support body. The radially inner clapper armature ends can jointly be supported at the support body. Adjustment means can adjust the position of the support body in a direction perpendicular to the structural face in such an amount that the adjusted face position is disposed parallel to the original face position. The adjusted face position can be disposed parallel to the original face position by a distance of from about 0.05 to 0.4 mm for decreasing or, respectively, for increasing of the clapper armature stroke. The adjustment means can include an electronically controllable adjustment drive engaging at the support body.

A method for controlling of print pins of a matrix pin print head comprises the following steps. A control order acts on an adjustment member whereby a geometric change of the operating air gap is performed between a magnet pole and a clapper armature. The operating voltage or the characteristics of the energy feed of an electromagnetic coil is changed for adaptation to the number of copies to be printed and/or for adaptation of the print frequency in the sense of a change in the print speed of a matrix printer.

The characteristics of the energy feed can be changed by a change in the operating voltage or in the operating current of the electromagnetic coil. The energy change can be effected automatically by a sensor scanning the recording substrate, where the sensor can initiate the adjustment means. The change can occur stepwise by a switch disposed at the matrix pin printer.

A computer can be connected to the matrix pin printer. The change signal can be transferred via the computer by an entered control order onto the matrix pin print head.

According to a first embodiment of the present invention, the drive energy is fed of equal size to each print pin and is changeable in each case in equal amounts, i.e. the drive force furnished to all the print pins can be increased or decreased by a certain defined amount. This simultaneous change of the drive force can be furnished less in an alternative sense, but more in a sense of combination by providing changes of equal sizes for each pin assembly with respect to the operating voltage, and with respect to the current feed curve together with the operating air gap. A change of the impact force at the tips of the print pins is the consequence of such change such that automatically less or more carbon copies can be printed. Depending on the number of carbon-copy sheets, the print head can be adjusted to a minimum sound level such that a reduction of the print noise occurs. This construction can furthermore be advantageously used in case of so-called pretensioned matrix print heads employing permanent magnets.

According to a second embodiment of the invention, there is provided a support body at which there positioned a face on which the radially inner clapper armature ends are jointly supported. The support body is parallel adjustable in an amount of about 0.05 to 0.4 mm for decreasing or, respectively, for increasing the clapper armature stroke. In this case, an electronically controllable adjustment drive is furnished, where the adjustment drive engages at the support body. Again in this case, the change of the impact force at the tips of the print pins can be easily changed, such that also less or more copies can be printed at one time.

According to a third embodiment, the control order, acting on a changing device, effects that there is performed a geometric change of the operating air gap between a magnet pole and a clapper armature in connection with a change of the operating voltage of the electromagnetic coil or with a change of the current feed curve or, respectively, of the current feed time of the electromagnetic coil. In this context, advantageously, the totality of the clapper armatures or the totality of the magnet yokes or another member, influencing the operating air gap, can be changed. In case the operating air gap between the armature and the magnet yoke cannot be further decreased or cannot be further increased, then it is possible additionally to change the operating voltage or, respectively, the current feed curve of the electromagnetic coil.

For improving the operation, there is provided that the energy change is performed automatically by a sensor sensing the recording substrate. In this case, the sensor initiates an adjustment member.

It is advantageous for the operator of a printer that a change of the adjustment can be performed in steps by a switch furnished at the matrix pin printer.

Furthermore, it is possible that the change can be performed and transmitted to the matrix pin print head via a computer connected to the matrix pin printer where the change is entered into the computer based on a control order.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
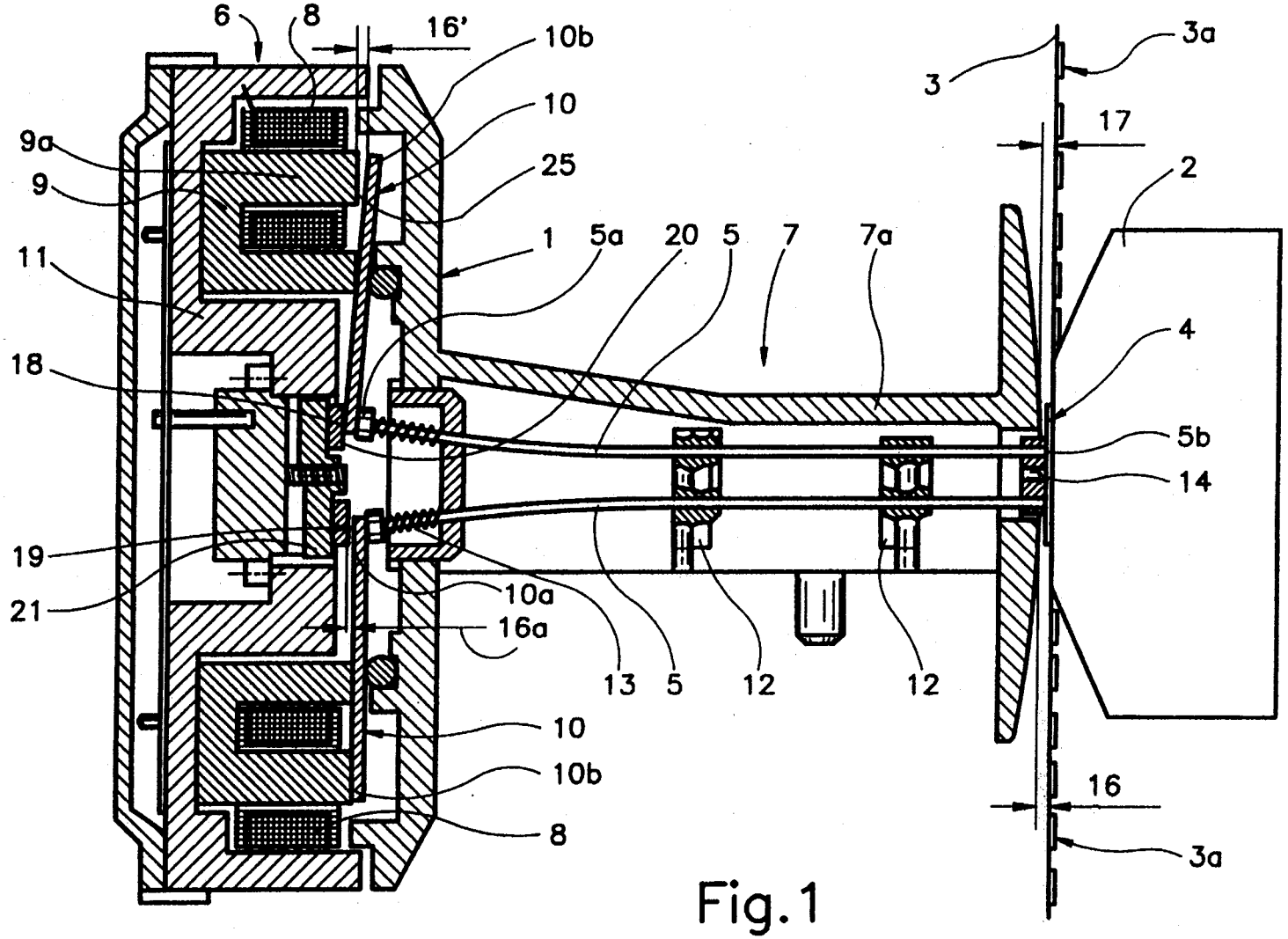
FIG. 1 illustrates a longitudinal sectional view through a matrix pin print head with operating air gaps, set differently in the two symmetry planes, in each case between a magnet yoke arm and the respective clapper armature.

According to the present invention, there is provided for a matrix pin print head which is adjustable or is adjusted at a fixed distance 17 relative to a print counter support 2. A recording substrate 3 rests on the print counter support 2. An ink ribbon 4 is guided in front of print pins 5 between the matrix pin print head 1 and the recording substrate 3. Pin drives formed in each case by a yoke 9 and a clapper armature 10 are coordinated jointly to the print pins 5 or individually to each print pin 5. In each case, an electromagnetic coil 8 is coordinated to the respective drives including yokes 9 and clapper armatures 10. Each print pin 5 can be moved within a stroke path 16 from a rearward withdrawn position 18 into a forward extended position 19 and back. A drive energy, fed of equal size in each case to each print pin 5, is changed in, in each case, in equal amounts, i.e. the drive energy can be set and controlled to be reduced or enlarged proportionally and uniformly for all pins.

In each case, a clapper armature 10 can drive the print pin 5. All clapper armatures 10 can rest in a rearward rest position 18 with a radially inner clapper armature end **10*a* at a joint face 20. All radially outer clapper armature ends 10*b* can transfer a drive force. The path of each print pin up into a forward extended print position 19 can correspond to the clapper armature stroke path 16'. The face 20 is disposed at a support body 21. The radially inner clapper armature ends 10*a* are jointly supported at the support body 21. The support body 21 is adjustable in a direction perpendicular to the face 20 in such an amount that the adjusted face 20 is disposed parallel to the original face 20 by an amount of from about 0.05 to 0.4 mm for decreasing or, respectively, for increasing of the clapper armature stroke 16', 16''. An electronically controllable adjustment drive 22 is furnished. Said adjustment drive 22 engages at the support body 21**.

A method for controlling of print pins of a matrix pin print head for adaptation to the number of copies to be printed and/or for adaptation of the print frequency in the sense of a change in the print speed of a matrix printer comprises the following steps. A control order 24 acting on an adjustment member 23 is effected. Thereby a geometric change of the operating air gap 25 is performed between a magnet pole **9*a* and a clapper armature 10 in connection with a change of the operating voltage of the electromagnetic coil 8 or with a change of the current feed curve or, respectively, the current feed time of the electromagnetic coil 8. The energy change can be effected automatically by a sensor 26 scanning the recording substrate 3, where the sensor 26 initiates the adjustment member 23. The change can occur stepwise by a switch 27 disposed at the matrix pin printer. The change can be transferred via a computer 28, connected to the matrix pin printer, by an entered control order 24 onto the matrix pin print head 1**.

The matrix pin print head 1 is adjusted to a fixed distance 17 relative to the print counter support 2, where a recording substrate 3 rests fully on the print counter support 2. The distance 17 is set after the assembly of the matrix pin print head 1 in the production facility during the final assembly of the printer. The fixed distance 17 can represent a minimum distance or a distance, which is adjusted by the operator with a lever based on a scale disposed at the printer. An ink ribbon 4 is disposed and guided between the matrix pin print head 1 and the recording substrate 3. A number of nine, eighteen, or twenty-four or more print pins 5 can be furnished for impacting via the ink ribbon 4 in order to generate the print dots of a character or of an image on the recording substrate 3.

In principle, the matrix pin print head 1 is subdivided into two functional groups, namely a drive group 6 for print pins 5 and a pin guide group 7. In this case, the drive group 6 comprises an electromagnetic coil 8 with magnet yoke 9 and a clapper armature coordinated to each print pin 5. The drive group 6 is mounted on a base plate 11. The pin guide group 7 is comprised of a pin casing **7*a* and of several pin guide supports 12 disposed in the pin casing 7*a*. Together, the pin casing 7*a*, base plate 11, and a back cover form a geometric body enveloping the components inside the print head 1**.

Each print pin 5 is substantially friction-loaded by the guidance in the pin guide supports 12 as well as by a support of a pin head **5*a*, which pin head 5*a* is subject to a spring force by a spring 13, and in addition by a guidance of the print pins 5 in a guide mouth piece 14. The drive energy, fed to each print pin 5 by the clapper armature 10, takes effect on the print force of the respective print pin 5 less the losses, which are generated by the occurring friction losses. The disposition illustrated in the top half of FIG. 1 effects a rearward withdrawn position of a print pin 5 as long as the electromagnetic coil 8 is without current. The clapper armatures 10 are disposed in a rearward withdrawn position 18 with which a certain drive energy and a certain stroke path 16 is associated, which is usually between 0.05 and 0.4 min. The drive energy, furnished to a print pin 5 during this stroke path 16 by way of a motion energy, determines the impact force of a print pin tip 5*b***.

The drive energy, fed in equal size in each case to each print pin 5, can be changed in respectively conforming amounts via a change of the operating voltage of the electromagnetic coil 8 or via the current feed curve and/or via the stroke path 16 or, respectively, the path 16' of a clapper armature. This means that the drive energy fed to each pin is controlled such that equal, proportional drive energy changes occur for each pin assembly in a direction of lower or higher forces. A higher drive energy feed corresponds to a larger number of copies **3*a* to be printed and a lower drive energy feed corresponds to a smaller number of copies 3*a*** to be printed.

The matrix pin print head 1 is set to a fixed distance 17 relative to a print counter support 2. The recording substrate 3 rests on the print counter support 2 substantially without an air gap. The ink ribbon 4 is moved between the guide mouth piece 14 and the recording substrate 3 with the copies **3*a***.

One single drive with an electromagnetic coil 8 is coordinated to each print pin 5 according to the embodiment of FIG. 1. Each print pin 5 is movable within the stroke path 16 or, respectively, the path 16' of the clapper armature from the illustrated rearward withdrawn position 18 into a forward extended position 19 and back. In the illustrated rearward withdrawn position 18, all clapper armatures 10 rest with a radially inner clapper armature end **10*a* at a joint face 20, while all radially outer clapper armature ends 10*b* transfer the drive force onto the print pin 5. The path covered by each print pin 5 to the forward extended position 19** corresponds to the clapper armature stroke, i.e. the stroke path 16 or, respectively, the path 16' of the clapper armature.

Each print pin 5 can also be moved within a shortened stroke path 16a, FIG. 1 lower half, into a forward extended position 19 and back. All clapper armatures 10 are resting with the radially inner clapper armature ends 10a at the joint face 20 in the illustrated rearward, withdrawn position 18, FIG. 1 upper half, whereas all radially outer clapper armature ends 10b transfer the drive force. The path, covered by each print pin 5 up to reaching the forward extended position 19, corresponds to the shortened clapper armature stroke, i.e. a shortened stroke path 16a.

Figure 2:
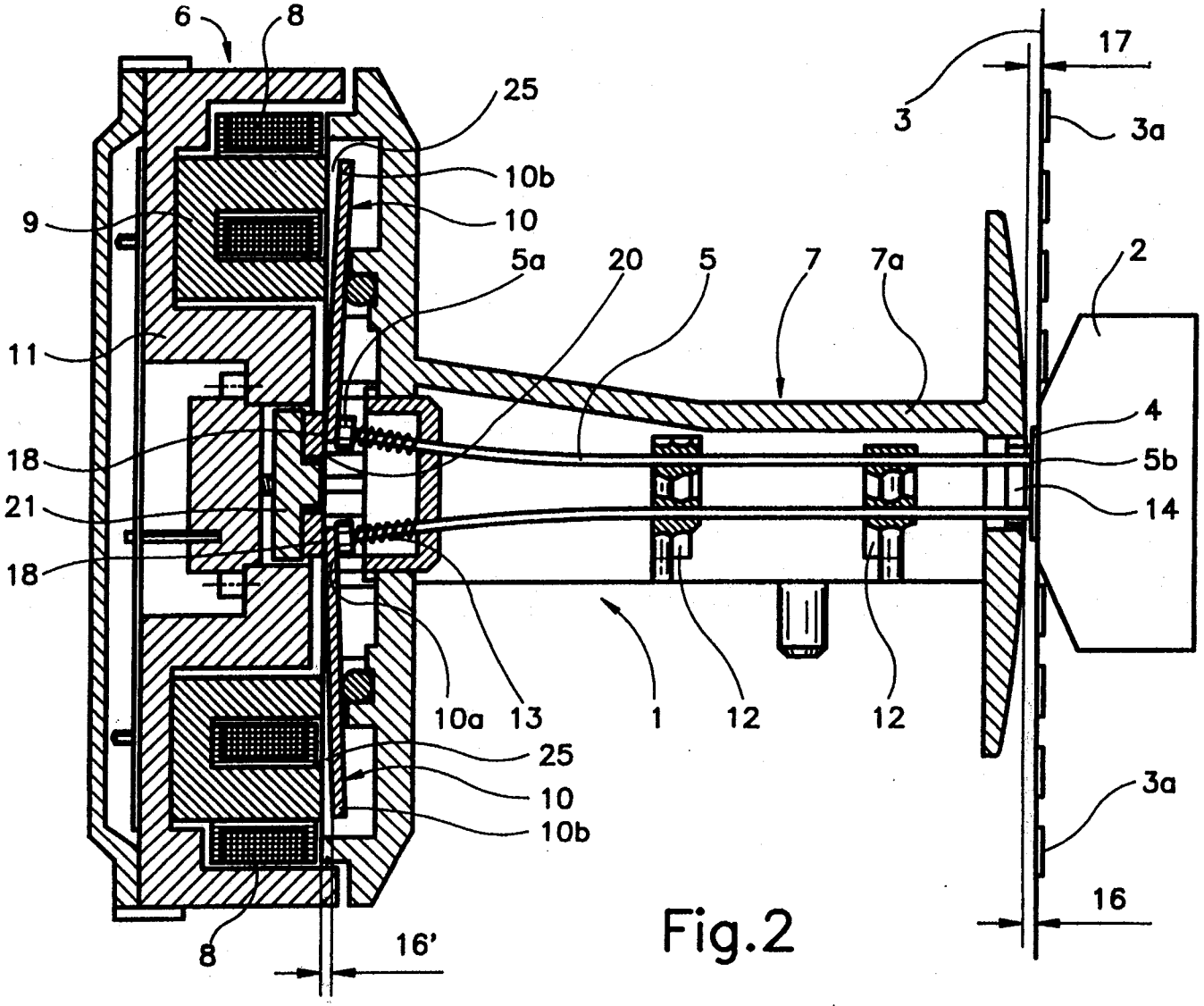
FIG. 2 is a longitudinal sectional view, similar to the embodiment of FIG. 1, through the matrix pin print head with the smallest adjustable operating air gap.

According to FIG. 2, all clapper armatures 10 rest with their radial inner clapper armature ends 10a at a joint face 20. The joint face 20, because of its shifted position, effects an increased stroke path 16 at the print pin tip 5b or, respectively, an increased clapper armature path 16''.

Figure 3:
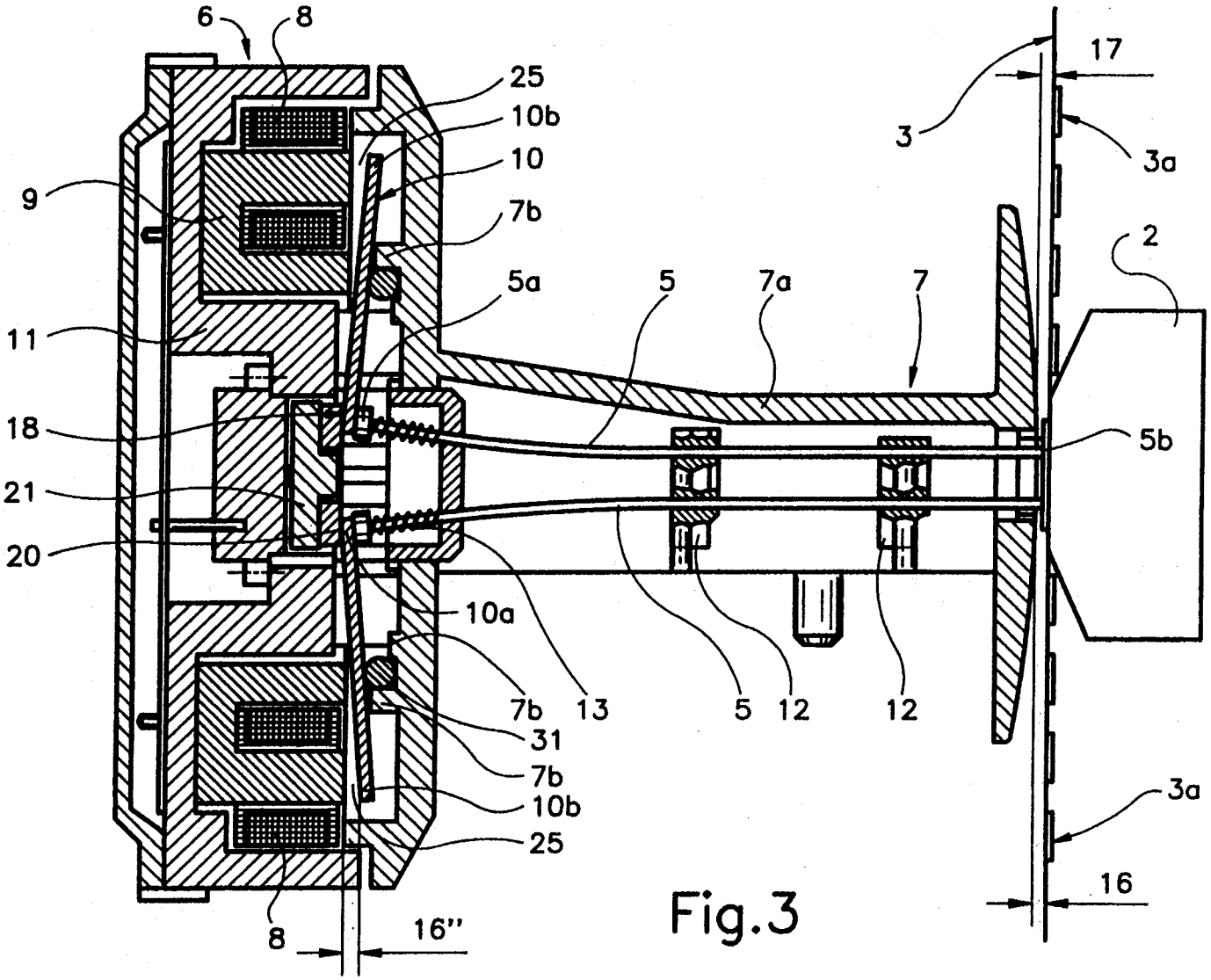
FIG. 3 is a longitudinal sectional view, similar to the embodiment of FIG. 1, through the matrix pin print head with the largest adjustable operating air gap.

A markedly increased clapper armature path 16'' is illustrated in FIG. 3. The clapper armature path 16' is not limited in case of a path 16'' based on an elastic support ring 31 or, respectively, by annular protrusions 7b of the pin casing 7a, where nevertheless all clapper armatures 10 rest clearly with their radially inner clapper armature ends 10a at the joint face 20.

Figure 4:
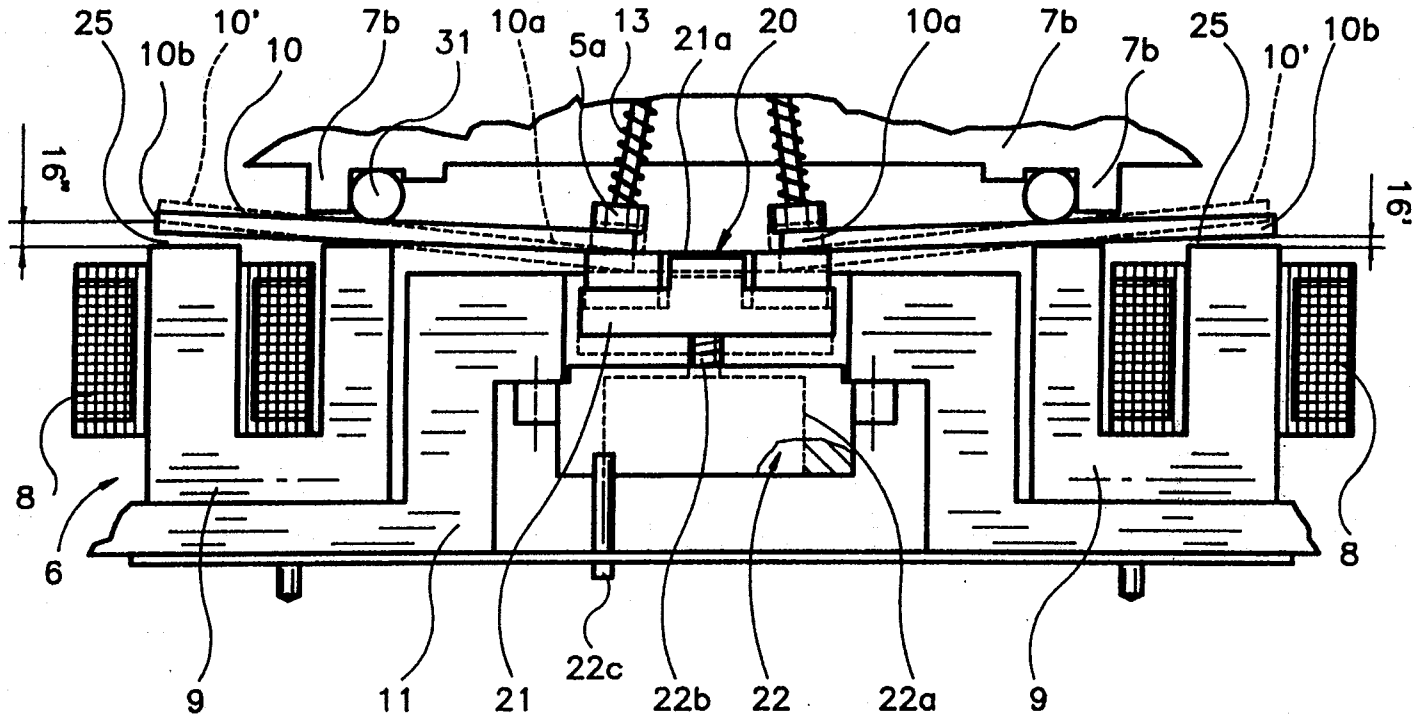
FIG. 4 is an enlarged detailed view in the area of the clapper armatures, where in each case the smallest and the largest operating air gap as well as in each case the rearward withdrawn position and the forward extended position of the print pins and of the clapper armatures are illustrated.

The joint face 20 is now formed by a support body 21, illustrated in FIG. 4, where the radially inner clapper armature ends 10a are jointly supported at the support body 21. The support body 21 is adjustable in its position parallel to the face 20, i.e. after adjustment, the support body exhibits a face 20 which is disposed parallel to the original face 20. This adjustment occurs by a shifting in a direction which is perpendicular to the face 20 and the adjustment path perpendicular to the face 20 amounts to about from 0.05 to 0.4 mm. The clapper armature stroke, i.e. the stroke path 16, is changed in this amount. The support body 21 carries a damper ring 21a, at which the face 20 is disposed. In order to adjust the support body 21, there is furnished an electronically controllable adjustment drive 22 which engages at the support body 21. The adjustment drive 22 can be formed from an electromagnet. As illustrated, the adjustment drive 22 comprises a rotary drive 22a with a threaded spindle 22b. A current connection 22c is disposed at the rotary drive 22a. Upon actuation of the adjustment drive 22 in one direction, the support body 21 for the damper ring 21a is moved from the position, for example as indicated with a fully drawn line, into a position indicated with a dashed line, illustrated in FIG. 4 from the right to the left, wherein the threaded spindle 22b is correspondingly turned. In the dashed-line position illustrated, the damper ring 21a also is disposed in the leftward adjusted position more remote from the pin, such that the armature 10' operates with an enlarged clapper armature path 16''.

Figure 5:
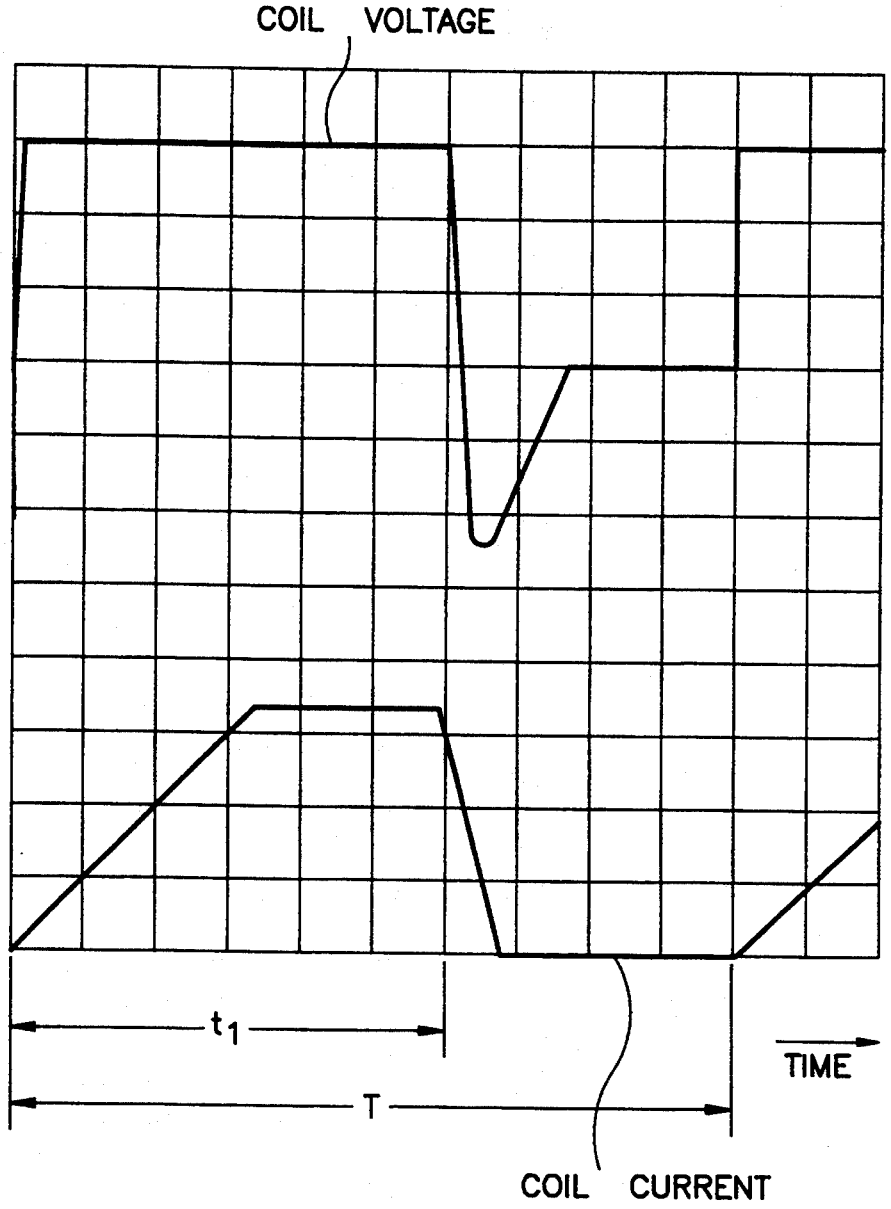
FIG. 5 is a current-feed and a voltage diagram.

The coil voltage (in volts) and the coil current (in amperes) are illustrated in FIG. 5 in a curve representing a course over the time $t_1$ or, respectively, T. In case of a correspondingly decreased current, the energy fed to the respective electromagnetic coil 8 decreases such that the corresponding print pin 5 receives a lower impact energy.

Figure 6:
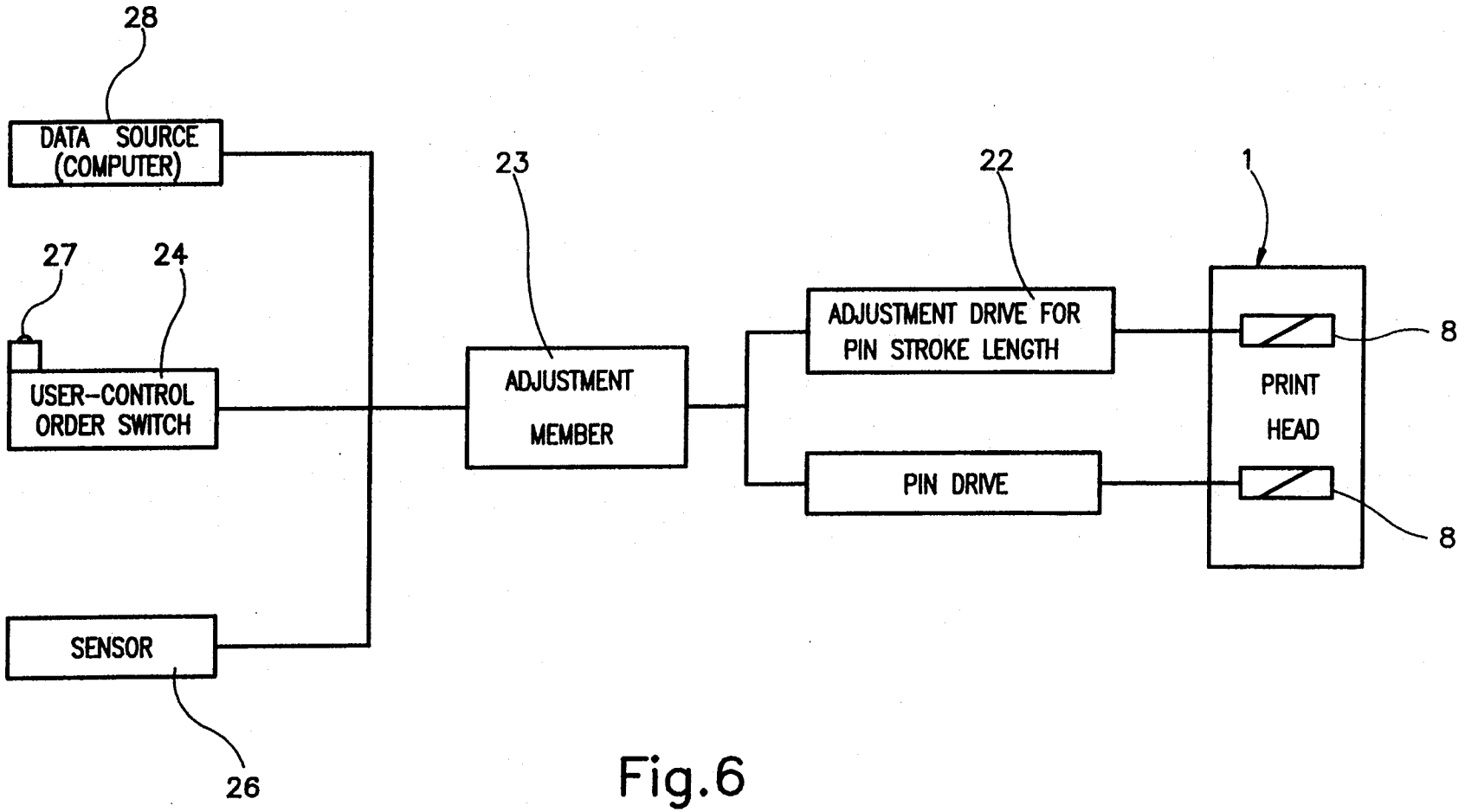
FIG. 6 is a schematic block circuit diagram illustrating the automatic control of the matrix pin print head.

The change of the energy feed is now performed by a method for the controlling of print pins of a matrix pin print head for the purpose of adapting the number of carbon copies to be printed and/or for the purpose of adapting the print frequency in the sense of a change of the print speed of a matrix printer. For this purpose, a control order 24 is furnished as illustrated in FIG. 6, which acts on an adjustment member 23, such as a microprocessor, whereby the geometric change of the operating air gap 25 occurs between a magnet pole 9a and a clapper armature 10. Additionally or alternatively, a change of the operating voltage of the electromagnetic coil 8 is induced by the control order 24 and additionally or alternatively a change of the current feed curve or, respectively, of the current feed time of the electromagnetic coil is performed.

This control order 24 to the adjustment member 23, i.e. to the microprocessor as the case may be, can also be initiated based on thickness differences of the paper to be printed in that the energy change is automatically captured by a sensor 26 scanning the recording substrate 3, and where the sensor 26 then furnishes a signal back to the microprocessor 23.

The setting of a respective optimum position of the operating air gap 25 is performed either in connection with the current feed curve or with the current feed time or with the operating voltage at the electromagnetic coil 8 by setting the changes stepwise with a switch 27 furnished at the matrix pin printer.

It is further advantageous that the change of the designated parameter is transferred via a computer 28, connected to the matrix printer, via a control order, entered into the computer, to the matrix pin print head 1 or, respectively, to the adjustment member 23, i.e. the microprocessor.

In the following, examples are furnished, illustrating how an operator can proceed in order to generate quality printing for a selected number of copies to be printed:

Example 1

The operator would like to print a paper together with several copies. After selection of the number of copies, the printer automatically sets the following values and parameters for the print head 1:

| | |
|---|---|
| Large air gap | 0.4 mm |
| Current feed time | 350 microseconds |
| Coil current | 2 amperes |
| Frequency | 2000 Hz |

Example 2

The operator would like to print a single-sheet paper at a high print speed. After selection of a single-sheet paper mode, the printer automatically sets the following values and parameters for the print head 1:

| | |
|---|---|
| Small air gap | 0.25 mm |
| Current feed time | 250 microseconds |
| Coil current | 1.2 ampere |
| Frequency | 3000 Hz |

It will be understood that each of the elements described above, or two or more together, may also find a useful application in other types of mechanical impacting devices differing from the types described above.

While the invention has been illustrated and described as embodied in the context of an adjustment device for setting the impact energy and frequency of pins in a matrix pin print head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A matrix pin print head, comprising:

a plurality of print pins, wherein an ink ribbon is guided in front of the plurality of print pins and between the plurality of print pins and a recording substrate;

a plurality of pin drives corresponding to the plurality of print pins, each pin drive comprising a yoke, an electromagnetic coil, and a clapper armature having a radially inner end coordinated with each print pin and a radially outer end forming an air gap between itself and each yoke;

a support body having a common structural face, the radially inner end of each armature resting in one rearward withdrawn position at the common structural face, each armature transferring a drive force, in response to its corresponding pin drive, to each print pin such that the print pin is movable within a stroke path from a rearward withdrawn position into a forward extended position to impact the ink ribbon and the recording substrate;

adjustment motor means attached to the support body for mechanically and geometrically servo adjusting the support body in a direction perpendicular to the common structural face so as to uniformly and proportionally reduce and enlarge the drive force, and thereby the air gap between each radially outer end and each yoke, transferred from each armature to each print pin;

the adjustment motor means and the support body being circumferentially surrounded by the plurality of pin drives so as to form a compact matrix pin print head.

2. The matrix pin print head according to claim 1, wherein the adjustment motor means comprises:

an electronic rotary drive having a threaded spindle engaging the support body such that rotation of the threaded spindle provides the mechanical adjustment of the support body.

3. The matrix pin print head according to claim 2 further comprising a geometric body, wherein the adjustment motor means is located within the geometric body, the geometric body also enveloping the plurality of electromagnetic coils.

4. The matrix pin print head according to claim 2, wherein an adjusted position of the common structural face is disposed parallel to an original position of the common structural face and is displaced by a distance of from about 0.05 to 0.4 mm for decreasing and increasing, respectively, a clapper armature stroke and wherein the adjustment motor means and the support body are disposed substantially centered relative to positions of the plurality of electromagnetic coils.

5. The matrix pin print head according to claim 2 wherein each pin drive feeds drive energy of equal size in each case to each of the plurality of print pins.

6. The matrix pin print head according to claim 2 wherein the support body is disposed within a geometric body enveloping edges of the electromagnetic coils, and wherein the support body is adjustable in a direction perpendicular to the common structural face in such an amount that an adjusted position of the common structural face is disposed parallel to an original position of the common structural face by an amount of from about 0.05 to 0.4 mm for decreasing and for increasing, respectively, a clapper armature stroke path.

7. The matrix pin print head according to claim 1, wherein the support body is displaced by a distance from about 0.05 to 0.4 mm for decreasing and increasing, respectively, the air gap between the radially outer end of each armature and its corresponding yoke.

8. The matrix pin print head according to claim 1 wherein the adjustment motor means is attached to the print head for servo adjusting the position of the support body in a direction perpendicular to the common structural face of the support body in such an amount that an adjusted face position is disposed parallel to an original face position.

9. The matrix pin print head according to claim 8, further comprising an electronic adjustment drive, wherein the adjustment motor means for adjusting the drive energy to be furnished uniformly to the plurality of print pins is electronically controllable with the electronic adjustment drive.

10. The matrix pin print head according to claim 8, wherein the adjustment motor means includes an adjustment drive disposed immediately at the support body.

11. A method for controlling the print pins of a matrix pin print head comprising the steps of:

providing a plurality of print pins;

providing a plurality of pin drives corresponding to the plurality of print pins, each pin drive having a yoke, an electromagnetic coil, and a clapper armature having a radially inner end coordinated to each print pin and a radially outer end forming an air gap between itself and each yoke;

providing a support body having a common structural face for supporting the radially inner end of each armature;

providing an adjustment motor means attached to the support body;

mechanically and geometrically servo adjusting the support body in a direction perpendicular to the common structural face so as to proportionally and uniformly reduce and enlarge a drive force, and thereby the air gap between each radially outer end and each yoke, transferred from each armature to each print pin;

circumferentially surrounding the adjustment motor means and the support body with the plurality of pin drives to provide a compact matrix pin print head.

12. The method for controlling print pins of a matrix pin print head according to claim 11 further comprising determining the number of copies to be printed by an entered control order; wherein a geometric change of the air gap is caused by moving of the support body, wherein the support body is disposed centered between the electromagnetic coils, and wherein the geometric change is induced with a signal delivered by the control order to the adjustment motor means.

13. The method according to claim 12 further comprising, scanning a recording substrate with a sensor;

automatically effecting an energy change by shifting the support body, wherein the sensor initiates the adjustment motor means.

14. The method according to claim 12 further comprising, inducing stepwise a positional change of the support body by correspondingly controlling a switch disposed at the matrix printer.

15. The method according to claim 12, wherein a positional change is controlled via a computer connected to the matrix printer and delivering the entered control order to the matrix pin print head.

16. The method according to claim 12 further comprising scanning a recording substrate with a sensor furnishing a control means;

controlling an energy change with a signal delivered by the sensor;

initiating an adjustment of a position of the support body.

17. The method for controlling print pins of a matrix pin print head according to claim 11 further comprising acting with a control signal on the adjustment motor means attached to the print head;

generating a positional change of the air gap between the yoke and the clapper armature for thereby changing a position of the support body for adaptation of impact force of a pin to the number of copies to be printed and for adaptation of the print frequency in the sense of a change in print speed of a matrix printer depending upon the number of copies to be impacted by the print pin.

18. A method for controlling print pins of a matrix pin print head in a matrix printer comprising the steps of:

providing a plurality of print pins;

providing a plurality of pin drives corresponding to the plurality of print pins, each pin drive having a yoke, an electromagnetic coil, and a clapper armature having a radially inner end coordinated to each print pin and a radially outer end forming an air gap between itself and each yoke;

providing a support body having a common structural face for supporting the radially inner end of each armature;

providing an adjustment motor means attached to the support body;

acting with a control signal on the adjustment motor means with a control means;

mechanically and geometrically servo adjusting the support body in a direction perpendicular to the common structural face for effecting a change in energy delivered to the print pins, wherein the control means is connected to the adjustment motor means and triggers the adjustment motor means thereby changing a position of the support body for the armatures;

circumferentially surrounding the adjustment motor means and the support body with the plurality of pin drives to provide a compact matrix pin print head.

19. The method for controlling print pins of a matrix pin print head according to claim 18, including changing the characteristics of an energy feed by providing a coordinated change in operating voltage of the electromagnetic coils.

20. The method for controlling print pins of a matrix pin print head according to claim 18, further comprising changing the characteristics of an energy feed by providing a coordinated change in an operating current for the electromagnetic coils.

21. The method according to claim 18, wherein the positional change occurs stepwise by a switch providing the control means and disposed at the matrix printer.

22. The method according to claim 18, further comprising connecting a computer providing the control means to the matrix printer;

transferring the control signal via the computer onto the matrix pin print head.

23. The method according to claim 18, wherein the geometric change occurs by a sensor furnishing the control means and scanning a recording substrate, wherein the sensor furnishes the control signal to a microprocessor and wherein the microprocessor initiates and energizes the adjustment motor means for the support body.

* * * * *